US007210274B2

(12) United States Patent
Ballantyne et al.

(10) Patent No.: US 7,210,274 B2
(45) Date of Patent: May 1, 2007

(54) DOOR STILE STRUCTURE

(76) Inventors: Mark Ballantyne, 8360 Elder Creek, Sacramento, CA (US) 95828; Douglas Smith, 8360 Elder Creek, Sacramento, CA (US) 95828; Grant Bennett, 8360 Elder Creek, Sacramento, CA (US) 95828

( * ) Notice: Subject to any disclaimer, the term of this patent is extended or adjusted under 35 U.S.C. 154(b) by 232 days.

(21) Appl. No.: 10/400,680

(22) Filed: Mar. 28, 2003

(65) Prior Publication Data

US 2004/0187428 A1 Sep. 30, 2004

(51) Int. Cl.
*E04C 3/16* (2006.01)

(52) U.S. Cl. ..... 52/366; 52/800.1; 52/457; 52/656.4; 52/455; 52/309.9

(58) Field of Classification Search ..... 52/366, 52/364, 800.1, 802.1, 457, 656.4, 455, 309.9
See application file for complete search history.

(56) References Cited

U.S. PATENT DOCUMENTS

| | | | | |
|---|---|---|---|---|
| 435,313 | A | 8/1890 | Lohse | |
| 635,341 | A | 10/1899 | Nash | |
| 2,399,666 | A | 5/1946 | Een | |
| 2,699,578 | A | 1/1955 | Marks | |
| 3,121,264 | A | 2/1964 | Hammar | |
| 3,254,592 | A | 6/1966 | Chase | |
| 3,798,863 | A | 3/1974 | Latson | |
| 3,950,894 | A | 4/1976 | DiMaio | |
| 4,265,067 | A | 5/1981 | Palmer | |
| 4,364,987 | A | 12/1982 | Goodwin | |
| 4,374,693 | A * | 2/1983 | Pitt | 156/267 |
| 5,074,087 | A | 12/1991 | Green | |
| 5,448,869 | A | 9/1995 | Unruh et al. | |
| 5,720,142 | A | 2/1998 | Morrison | |
| 5,737,890 | A | 4/1998 | Heyden | |
| 5,934,040 | A | 8/1999 | Chen | |
| 6,308,463 | B1 | 10/2001 | Bennett | |
| 6,311,454 | B1 | 11/2001 | Kempel | |
| 2002/0124497 | A1 | 9/2002 | Fortin et al. | |

FOREIGN PATENT DOCUMENTS

| | | |
|---|---|---|
| WO | WO 02/31306 A1 | 4/2002 |

* cited by examiner

*Primary Examiner*—Laurie K. Cranmer
(74) *Attorney, Agent, or Firm*—Theodore J. Bielen, Jr.

(57) ABSTRACT

A door stile structure utilizing a pair of skins. An elongated member extends between at least a portion of the pair of skins. The elongated member includes an outer surface having a pair of ridges with a recessed portion therebetween. The ridges lie in a plane which intersects the edge of the door. The elongated member may lie flush with the edges of the skins forming the door or be imbedded within the skins to lock the elongated member into the door structure.

6 Claims, 3 Drawing Sheets

DOOR STILE STRUCTURE

BACKGROUND OF THE INVENTION

The present invention relates to a novel and useful door stile structure.

Modern doors are typically formed with a frame including vertical stiles spanned by horizontal rails. Muntins and panels may also lie within the frame formed by the stiles and rails. Skins are normally employed to enclose the stiles and rails leaving the panel surfaces visible for the sake of esthetics.

At least one of the stiles is employed to receive mounting hardware, such as hinges to rotatably hold the door to a jamb of a door opening. Fasteners such as screws are typically used to hold the hinges to the door stile, in this regard. Needless to say, the stile employed for mounting hinges must be constructed so as not to be displaced by the torque or moment generated by the weight of the door.

In the past, many types of door stiles have been proposed to form door structures. For example, U.S. Pat. Nos. 2,699,578, 4,265,067, 4,364,987, 5,448,869, and 5,737,890 describe door and window frame assemblies in which a stile of rectangular configuration is used as a base for supporting hardware.

U.S. Pat. No. 6,308,463 shows a hinge assembly which employs dowels that are imbedded in the core of the door to hold metallic fasteners used to mount hinges.

U.S. Pat. Nos. 3,798,863, 5,934,040, and 6,311,454 illustrate door constructions in which stile frame members are formed as interlocking pieces to enhance strength.

U.S. patent application Ser. No. 2002/0124497 shows a fire resistant door edge in which an intumescent strip seal is placed adjacent the stile holding the hinge hardware.

U.S. Pat. Nos. 435,313, 635,341, 3,254,592, and Publication WO 0231306 describe door stiles in which interlocking tongues in the form of mortis and tenon structures are used between the stile and the interior portions of the door to increase the sturdiness of the door unit.

U.S. Pat. Nos. 2,399,666, 3,950,894, 5,074,087 and 5,720,142 teach stile structure having notches or grooves for aiding in the interlocking of the stile to the skins of the door.

A door structure which includes a stile that resists separation from the door unit as a whole would be a notable advance in the building and construction field.

BRIEF SUMMARY OF THE INVENTION

In accordance with the present invention a novel and useful door stile structure is herein provided.

The door stile structure of the present invention utilizes an elongated member which extends between at least a portion of first and second skins in a sandwich configuration. The elongated member includes an outer surface having a first ridge, a second ridge, and recessed portion between the first and second ridges. The outer surface of the elongated member faces the first or second skin. A second surface similarly constructed may also be found on the elongated member to face the remaining skin.

Fixing means may be utilized to hold the elongated member between the first and second skins to form a door unit. Such fixing means may take the form of fasteners, glue layers, and the like. The certain instances the elongated member includes an extending intermediate surface located between the first and second ridges and forms the recessed portion. Such intermediate surface may meet the ridges at an angle which may be orthogonal or non-orthogonal. In addition, cavities may be formed on the intermediate surface of the recessed portion to accommodate or accept a portion of a glue layer which may be located between the elongated member and the first and/or second skins.

Another embodiment of the present invention employs a door stile formed from an elongated member positioned between the first and second skins and constructed with a narrow portion and a thick portion. The narrow and thick portions would be spanned or connected by a planar surface to form a wedge-like cross-sectional configuration. Where the fixing means takes the form of fasteners, gluing, and the like, the first and second skins would overlie the elongated member and form an edge. The first narrow portion of the elongated member would lie at the edge of the door unit and the think portion would lie within the door unit.

Yet another embodiment of the present invention takes the form of one elongated member which extends at least between a portion of the first and second skins which form an edge of a door unit. The one elongated member would lie inwardly from and substantially parallel to the edge of the door formed by the first and second skins in an embedded format. In certain instances, another elongated member may lie inwardly and substantially parallel to the edge of the door unit and be positioned further inwardly from the edge of the door unit than the one elongated member. In this manner, fasteners may engage the one and another elongated members, locked within the door unit to support of the mounting hardware of the door unit.

It may be apparent that a novel and useful door stile structure has been hereinabove described.

It is therefore an object of the present invention to provide a door stile structure which is extremely strong and resists forces tending to separate the door unit exerted by the door hardware.

Another object of the present invention is to provide a door stile structure in which a door stile takes a form which interacts with the skins forming the door unit to serve as a interlocking member.

A further object of the present invention is to provide a door stile structure in which a door stile interacts with the skins of the door and is susceptible to fixation by a glue layer.

Another object of the present invention is to provide a door stile structure in which cavities are formed on the door stile to strengthen a glue layer between the door stile and the skins forming the door unit.

A further object of the present invention is to provide a door stile structure which is adaptable for to usage in panel doors of various configurations without alternation of the form of the door stile itself.

The invention possesses other objects and advantages especially as concerns particular characteristics thereof which should become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in combination with the drawings heretofore described.

Figure 1:
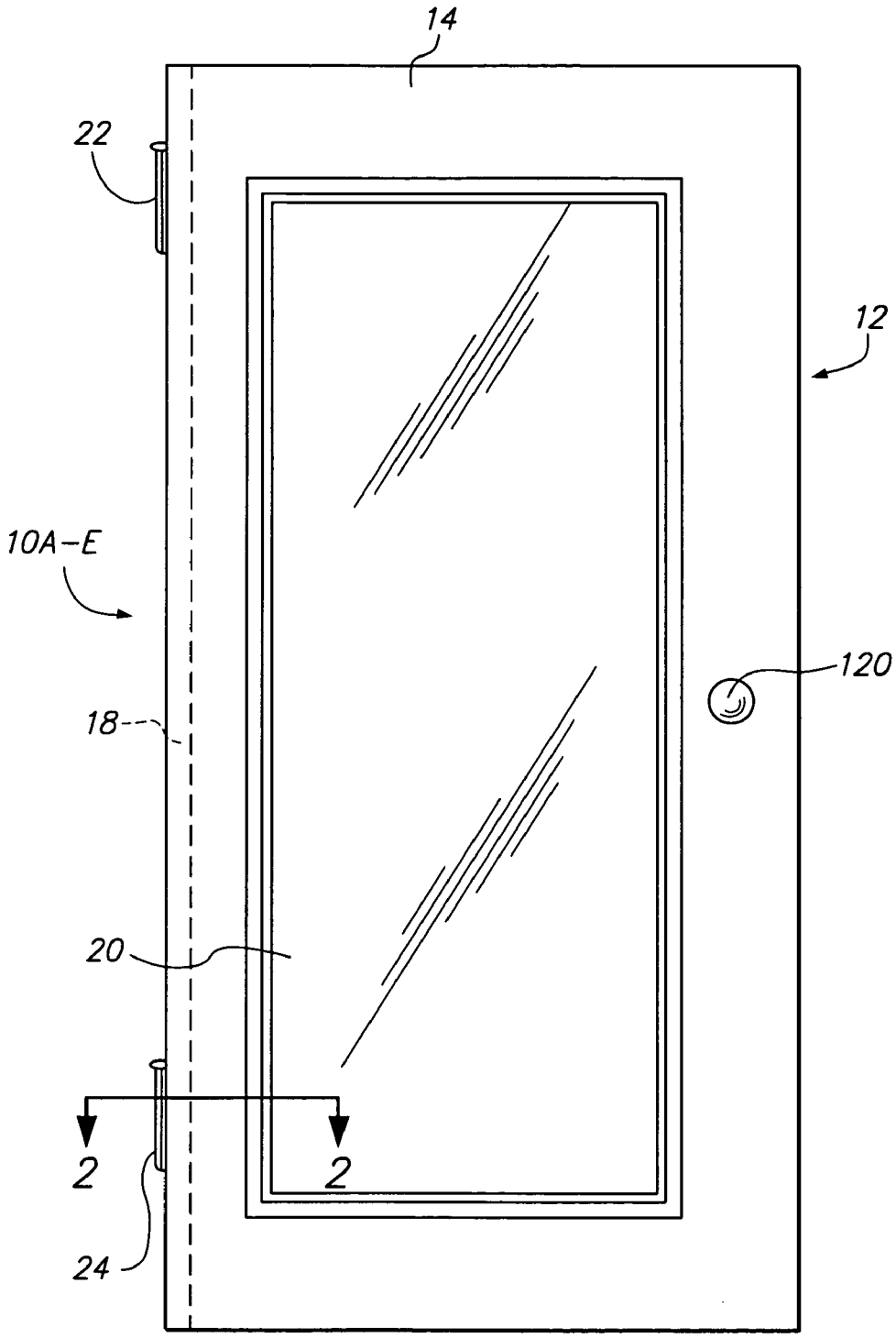
FIG. 1 is a front elevational view of a door unit formed with the embodiment of the door stiles of the present invention depicted schematically, in phantom.

Preferred embodiments of the invention are depicted in the drawings by reference character 10 followed by an uppercase letter to denote variations thereof. FIG. 1 depicts a door 12 including embodiments of the stiles door units 10A–10E of the present invention depicted schematically in phantom, FIGS. 2–6. With respect to door unit 10A, a panel door 12 includes skins 14 and 16 which are sandwiched to a stile 18, FIGS. 1 and 2. A single panel 20 is depicted in door 12 although it should be understood doors having multiple panels of opaque, and translucent materials may also be employed with the present invention. Hinges 22 and 24 have been fastened to panel door 12 and are capable of also fastening to a jamb of a doorway (not shown) to mount panel door 12 in place.

Figure 2:
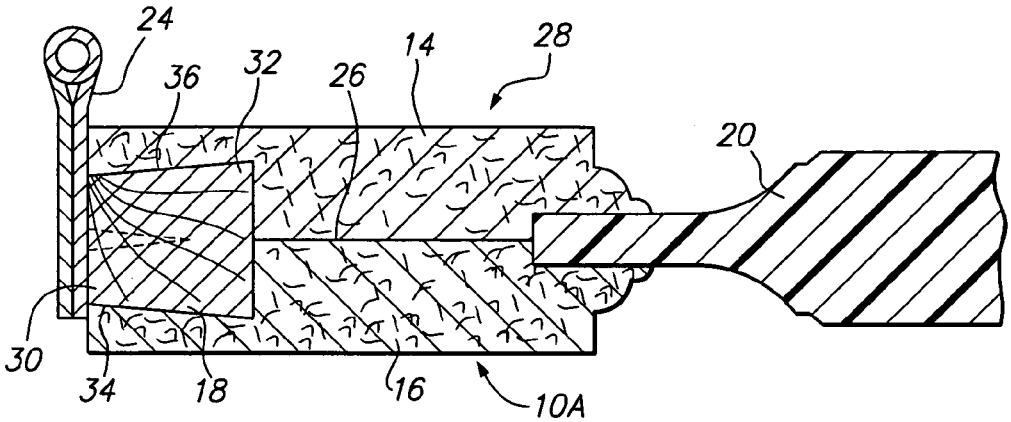
FIG. 2 is a sectional view taken along line 2—2 of FIG. 1 showing a first embodiment of the present invention.

With further reference to FIG. 2, it may be observed that stile 18 and panel 20 are held in sandwiched configuration by skins 14 and 16 to form a door unit 10A. Glue layers such as exemplar glue layer 26 represents means 28 for fixing or holding elongated member 18 between first and second skins 14 and 16. Stile 18 is formed with a first narrow portion 30 and a second thick portion 32. Planar surfaces 34 and 36 span narrow portion 30 and thick portion 32 of stile 18 in cross-sectional configuration. In other words, stile 18 appears to be a wedge shaped member in cross-sectional configuration which aids in the locking of the same to door unit 10 to resist the separation forces exerted between door unit 10A and hinge 24. It should be realized that hinge 24 may be employed in the hereinafter described door units 10B–10E.

Figure 3:
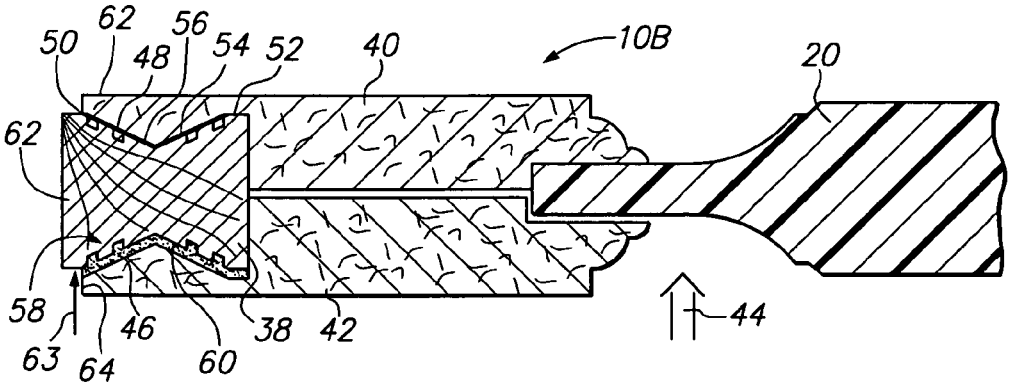
FIG. 3 is a sectional view similar to the one depicted in FIG. 2 showing second embodiment of the door stile which may be employed with the door depicted in FIG. 1.

Turning to FIG. 3, another embodiment 10B of the present invention is depicted. Door unit 10B includes an elongated member or stile 38 which lies between portions of skins 40 and 42. As shown in FIG. 3, stile 38 has been positioned into place but skin 42 is slightly separated from the remainder of door-oriented 10B for the purpose of demonstrating assembly of unit 10B. Directional arrow 44 indicates the movement of skin 42 in order to assemble unit 10B. Again, glue layers may serve as means 28 for fixing or holding elongated member 38 to skins 40 and 42. Exemplar glue layers 46 and 48 are depicted in FIG. 3 in this regard. Elongated member or stile 38 possesses a "bowtie" cross-sectional configuration formed by a first ridge 50, and second ridge 52 and a recess portion therebetween on one side of stile 38. A similar structure exists on the other side of stile 38. Recess portion 54 includes an extending surface 56 which meets ridges 50 and 52 at an angular configuration. In the embodiment 10B depicted in FIG. 3 such angular orientation of surface 56 relative to ridges 50 and 52 is a non-orthogonal one. A plurality of cavities 58 along surface 56 and opposite surface 60 serves to accommodate or accept glue from exemplar glue layers 46 and 48. Cavities 58 add to the strength of door unit 10B in its finished format. Edge portion 62 of stile 38 may be trimmed, directional arrow 63, to lie flush with the edges 62 and 64 of skins 40 and 42.

Figure 4:
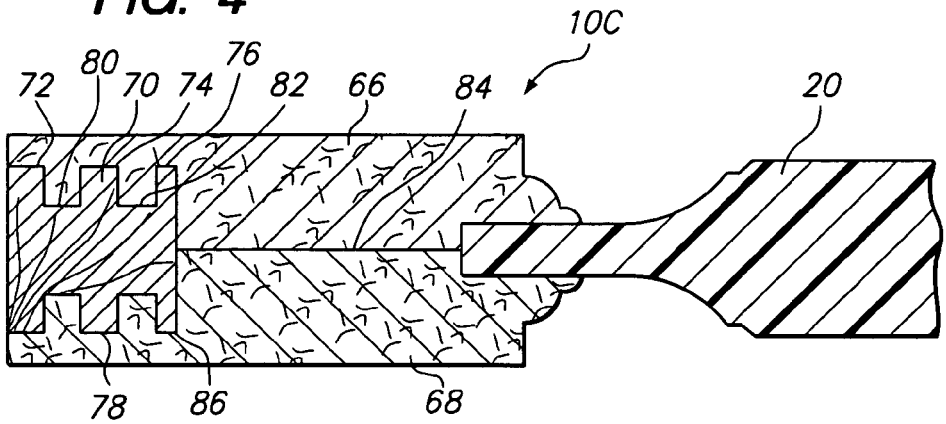
FIG. 4 is a sectional view similar to that depicted in FIG. 2 in which third embodiment of the door stile is employed with to door depicted in FIG. 1.

Referring now to FIG. 4, another embodiment 10C of the structure is depicted. Skins 66 and 68 sandwich elongated stile member 70 therewithin. Again, ridges 72, 74, and 76 are shown on one side of stile 70. A similar arrangement appears on the other side 78 of stile 70. Recesses 80 and 82 lie between ridges 72 and 70 and ridges 74 and 76, respectively. A similar arrangement appears on side 78 of stile 70. The surfaces forming recesses 80 and 82 meet ridges 72, 74, and 76 at a right angle or orthogonally. Again exemplar glue layers 84 and 86 represent means 28 for holding skins 66, and 68 to stile 70.

Figure 5:
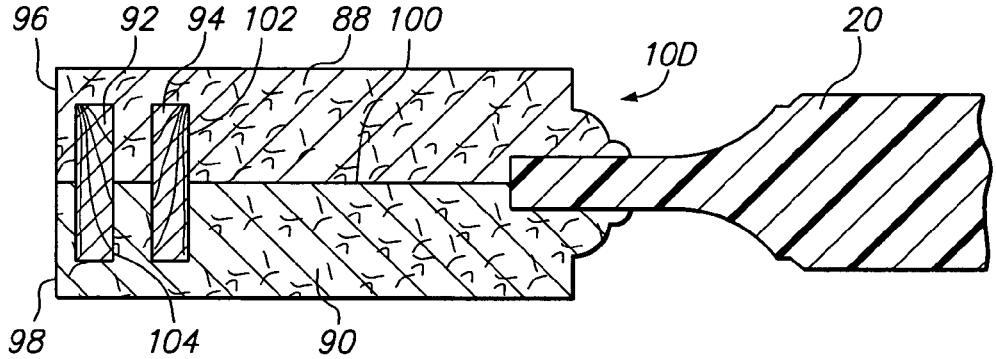
FIG. 5 is a sectional view similar to that depicted in FIG. 2 in which a fourth embodiment of a door stile is shown and may be used with the door depicted in FIG. 1.

With reference to FIG. 5, the embodiment 10D is shown. Skins 88 and 90 surround elongated members 92 and 94 which serve as a stile for embodiment 10D. That is to say, elongated members 92 and 94 lie inwardly from the edges 96 and 98 formed by skins 88 and 90, respectively. Again glue layers such as glue exemplar layers 100, 102, and 104 hold elongated members 92 and 94 in place.

Figure 6:
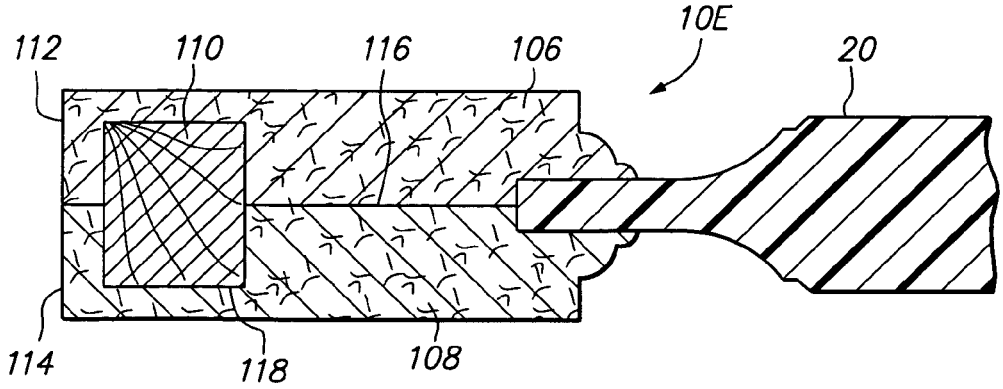
FIG. 6 is a sectional view similar to that depicted in FIG. 2 and illustrating a fifth embodiment of a door stile which may be employed with the door shown in FIG. 1.

FIG. 6 represents embodiment 10E of the present invention which may be considered to be an alternate embodiment of 10D of FIG. 5. Structure 10E includes skins 106 and 108 which hold embedded elongated member or stile 110 in place. Again, stile 110 lies inwardly from edges 112 and 114 of skins 106 and 108, respectively. Glue layers 116 and 118 serve as means 128 for fixing elongated member stile 110, skin 106 and skin 108 together as a unit forming structure 10E.

In operation, door structure 10A–10E is formed by using a stile of a particular cross-sectional configuration illustrated in FIGS. 2–6 between skins formed to snuggly hold the same in place. For example with respect to the embodiment depicted in FIG. 2, means 28 for holding skins 14 and 16 to stile 18 include glue layers 26. Following assembly of door structures 10A–10E, hinges 22 and 24 are attached as exemplified by hinge 24 in FIG. 2. Door units 10A–10E are then ready for positioning to a jamb within a doorway for use. Doorknob 120 allows the user to open and close any one of the door units 10A–10E.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A door stile structure employed with first and second skins, comprising:

a. an elongated member extending between at least a portion of the first and second skins, said elongated member including an outer surface having a first ridge, a second ridge and a recessed portion between said first and second ridges, said outer surface of said elongated member selectively facing said first and second skins, said recess of said elongated member further including an intermediate surface extending between said first and second ridges, said intermediate surface being angularly oriented relative to said first ridge, said intermediate surface angular orientation relative to said first ridge substantially comprising a non-orthogonal angular orientation; and b. fixing means for holding said elongated member between said first and second skins to form a door unit.

2. The structure of claim 1 in which said recessed portion includes at least one cavity and a glue layer between said first skin and said elongated member, said cavity being capable of holding at least a portion of said glue layer.

3. The structure of claim 2 in which said cavity lies on said intermediate surface.

4. A door stile structure employed with first and second skins, comprising:

a. a first elongated member extending between at least a portion of the first and second skins;

b. a second elongated member extending between at least a portion of the first and second skins, said second elongated member lying apart from said first elongated member and being separated from said first elongated member by at least a portion of said first and second skins; and c. fixing means for holding said first and second elongated members between said first and second skins to form a door unit with an edge.

5. The structure of claim 4 in which said first and second elongated members each lie substantially parallel to said edge of said door unit.

6. A door stile structure employed with first and second skins, comprising:

a. an elongated member extending between at least a portion of the first and second skins, said elongated member including an outer surface having a first ridge, a second ridge and a recessed portion between said first and second ridges, said outer surface of said elongated member selectively facing said first and second skins, said recess of said elongated member further including an intermediate surface extending between said first and second ridges, said intermediate surface being angularly oriented relative to said second ridge, said intermediate surface angular orientation relative to said second ridge substantially comprising a non-orthogonal angular orientation; and b. fixing means for holding said elongated member between said first and second skins to form a door unit.

* * * * *